US008201486B1

(12) United States Patent
Fuhrman

(10) Patent No.: US 8,201,486 B1
(45) Date of Patent: Jun. 19, 2012

(54) TWO-STAGE LIGHT GAS GUN

(76) Inventor: Michael L. Fuhrman, Tucson, AZ (US)

( * ) Notice: Subject to any disclaimer, the term of this patent is extended or adjusted under 35 U.S.C. 154(b) by 304 days.

(21) Appl. No.: 12/686,271

(22) Filed: Jan. 12, 2010

(51) Int. Cl.
*F41A 1/04* (2006.01)

(52) U.S. Cl. ..... 89/7

(58) Field of Classification Search ..... 124/60, 124/73; 89/7, 8
See application file for complete search history.

(56) References Cited

U.S. PATENT DOCUMENTS

| | | | | |
|---|---|---|---|---|
| 2,882,796 | A * | 4/1959 | Clark et al. | 89/7 |
| 3,126,789 | A * | 3/1964 | Meyer | 89/8 |
| 3,311,020 | A * | 3/1967 | Piacesi et al. | 89/8 |
| 4,022,053 | A | 5/1977 | Teng et al. | 73/12 |
| 4,038,903 | A | 8/1977 | Wohlford | 89/8 |
| 4,049,367 | A * | 9/1977 | Tominaga et al. | 425/77 |
| 4,161,904 | A * | 7/1979 | Groen et al. | 89/7 |
| 4,537,112 | A * | 8/1985 | Dabonde | 86/37 |
| 4,658,699 | A | 4/1987 | Dahm | 89/8 |
| 4,924,750 | A | 5/1990 | Neugebauer | 89/8 |
| H927 | H | 6/1991 | Miller | 102/440 |
| 5,127,308 | A | 7/1992 | Thompson et al. | 89/8 |
| 5,142,962 | A | 9/1992 | Hawke | 89/8 |
| 5,155,290 | A | 10/1992 | Hawke | 89/8 |
| 5,191,164 | A | 3/1993 | Hawke et al. | 89/8 |
| 5,194,690 | A | 3/1993 | Guthrie et al. | 102/440 |
| 5,239,930 | A | 8/1993 | Adam et al. | 102/522 |
| 5,275,083 | A | 1/1994 | Hawke et al. | 89/8 |
| 5,303,632 | A | 4/1994 | Kivity | 89/7 |
| 5,303,633 | A | 4/1994 | Guthrie et al. | 89/8 |
| 5,365,913 | A * | 11/1994 | Walton | 124/75 |
| 5,421,237 | A | 6/1995 | Naumann | 89/8 |
| 5,429,030 | A | 7/1995 | Tidman | 89/7 |
| 5,431,083 | A | 7/1995 | Vassioukevitch | 89/8 |
| 5,715,803 | A * | 2/1998 | Mattern | 124/70 |
| 5,743,246 | A * | 4/1998 | Mattern | 124/56 |
| 5,762,057 | A | 6/1998 | Laabs et al. | 124/56 |
| 5,785,038 | A * | 7/1998 | Mattern | 124/56 |
| 5,996,746 | A * | 12/1999 | Turner et al. | 188/269 |
| 7,954,413 | B2 * | 6/2011 | Koth | 89/7 |
| 2009/0108845 | A1 | 4/2009 | Kaminski | 324/337 |
| 2010/0212481 | A1 * | 8/2010 | Koth | 89/7 |

* cited by examiner

*Primary Examiner* — Troy Chambers
(74) *Attorney, Agent, or Firm* — Hayes Soloway P.C.

(57) ABSTRACT

A stage light gas gun system and method capable of having a variable power output to match a specific use or application. The light gas gun uses a high pressure hydraulic oil system to provide a propulsive force behind two-stage piston system that is used to compress a light gas. The light gas gun may include a punch formed on the second piston for piercing a rupture disk at a pre-determined point in order to provide predictable performance.

23 Claims, 2 Drawing Sheets

TWO-STAGE LIGHT GAS GUN

FIELD OF THE INVENTION

The present disclosure relates to a device for accelerating a projectile and, more particularly, to a light gas gun.

BACKGROUND OF THE INVENTION

A light gas gun is a projectile launcher employing a gas having a low atomic number, usually hydrogen or helium. One limiting factor on the speed of a projectile coming from a gun is the speed of sound in the working fluid. This is because the pressure waves created by the propulsive force are essentially unable to propagate speeds higher than the speed of sound within a given medium. Thus, light gases are particularly advantageous for accelerating a projectile at very high velocities because the speed of sound in a gas is a function of the inverse square root of the molecular weight. The speed of sound also increases with the temperature of the fluid so that heat formed by the compression of the light gas also serves to increase the maximum possible speed.

In a typical application, the light gas is pressurized and/or heated in a chamber having a rupture disk located at one end. In some examples, this is done by using a large diameter piston, powered by an explosive chemical reaction, to force a gaseous working fluid through a smaller diameter chamber containing the projectile to be accelerated. The rupture disk is situated behind a projectile located within a barrel. In response to the increased pressure and/or heat, the light gas ruptures the carefully calibrated rupture disk and then is brought at very high velocity against the rear of the projectile, thereby accelerating the projectile from a breech of a barrel through the barrel muzzle.

Some designs employ a multi-stage piston, wherein by using multiple pistons in series, each piston residing in a chamber with successively smaller cross-sectional area, the final piston is accelerated to compress the light gas very quickly into an area that is at or near the cross-sectional area of the projectile and/or sabot. See, e.g., U.S. Pat. No. 3,311,020; and U.S. Pat. No. 4,658,699.

One limitation of present designs is the use of explosives, which is the exclusive source of propulsive force in the prior art designs. Light gas guns are often used in jurisdictions where the use of such explosive charges requires a permit. Because a light gas gun may be used only occasionally in a single location, the process of procuring a permit is a significant issue. Also, the use of such explosive charges creates obvious safety issues. See, e.g., U.S. Pat. No. 4,038,903; U.S. Pat. No. 5,194,690; and U.S. Pat. No. 5,429,030.

Another limitation of prior art designs is the need for precise manufacturing of rupture disks. The rupture disk is essentially the triggering mechanism by allowing the light gas gun to fire when the rupture disk fails. Current designs require rupture disks to be manufactured to very precise specifications in order to achieve predictable performance. This increases the cost of operating a light gas gun while presenting some questions regarding the ability to tailor the performance to a specific application. See, e.g., U.S. Pat. No. 5,762,057.

Thus, there remains a need in the art for a light gas gun apparatus and associated method that is versatile yet predictable, and which may operate without the use of explosive charges.

SUMMARY OF THE INVENTION

The present disclosure addresses the deficiencies of current designs by providing a light gas gun that is capable of operating without explosive charges and which discharges the projectile in a predictable manner to achieve a specific performance.

One aspect of the present disclosure provides a system for accelerating a projectile using a light gas that provides hydraulic oil at high pressures to produce a propulsive force. This propulsive force is provided without the use of explosives and is supplied to a light gas gun having at least one piston. The light gas is preferably helium, but may also be another light gas such as hydrogen. The light gas gun may, for example, be configured with a first piston and a second piston, a hydraulic fluid residing between the two, the second piston having a smaller cross-sectional area when compared with the first piston, wherein the second piston is used to compress a light gas behind a rupture disk. The system also includes a light gas source for supplying the light gas to the light gas gun for each round fired. The rupture disk is placed between the light gas and the projectile, which is located at the end of a barrel closest to the breech. A reducing cone may be used to transition the flow of the light gas into the barrel.

Another aspect of the present disclosure provides a light gas gun having a pneumatic piston residing in a breech chamber for compressing a light gas; a rupture disk for retaining the light gas within the breech chamber until the light gas reaches a predetermined volume; a punch formed on a leading face of the pneumatic piston for puncturing the rupture disk when the light gas reaches the predetermined volume; and a barrel, into which the light gas enters upon the puncturing of the rupture disk, wherein a projectile may be place in the barrel near the rupture disk. The light gas is preferably helium, but may also be another light gas such as hydrogen. The light gas gun may include a hydraulic piston residing in a breech head chamber, which transfers a propulsive force to the pneumatic piston, wherein a working fluid, such as for example hydraulic oil, is contained between the two pistons. The breech head chamber may be formed to have a greater cross-sectional area than the breech chamber. The hydraulic piston may be driven, for example, by a propulsive force from a high pressure hydraulic pump. Alternatively, the propulsive force may be provided by an explosive charge.

Yet another aspect of the present disclosure provides a method for accelerating a projectile using a light gas gun, comprising providing hydraulic oil at high pressure to a first chamber containing a first piston; compressing a light gas in a second chamber containing a second piston, wherein a cross-sectional area of the second chamber being smaller than a cross-sectional area of the first chamber; and expelling the compressed light gas behind a projectile once the light gas has been compressed to a pre-determined level; and accelerating the projectile through a barrel. The step of expelling the compressed light gas may be performed using a punch attached to the second piston to pierce a rupture disk when the light gas has been compressed to said pre-determined level, which may be a volume, or a pressure, or a combination thereof with temperature.

BRIEF DESCRIPTION OF THE DRAWINGS

Further features and advantages of the present invention will be seen from the following detailed description, taken in conjunction with the accompanying drawings, wherein.

DETAILED DESCRIPTION OF THE INVENTION

Figure 1:
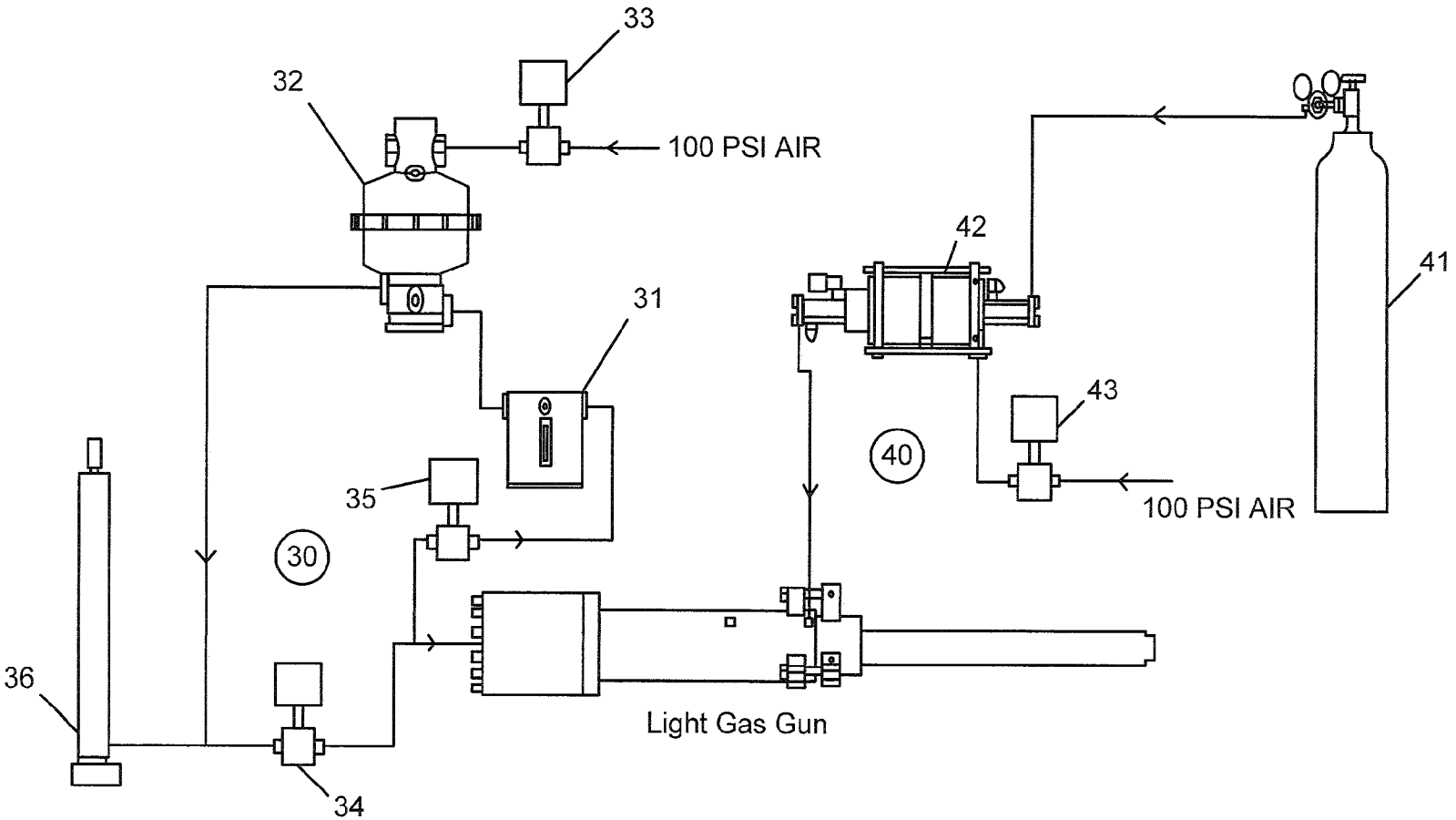
FIG. 1 is a schematic of a light gas gun apparatus according to the present disclosure.

In the following description, reference is made to the accompanying drawings, which form a part hereof, and in which is shown, by way of illustration, various embodiments of the present disclosure. It is understood that other embodiments may be utilized and changes may be made without departing from the scope of the present invention.

The present disclosure provides a two stage light gas gun that produces significantly higher power output when compared with a conventional, explosive-charged gun of equal size. The light gas gun of the present disclosure will have a variable power output which may be chosen to for a specific use or application. The increased power may be attributed to several stages of power increases derived from mechanical advantages gained by utilizing hydraulic and pneumatic principles.

Referring to FIGS. 1-3D, the light gas gun of the present disclosure utilizes hydraulic pressure from a first amount of hydraulic oil from a hydraulic compression system 30 to drive a first piston 10 (also referred to herein as a hydraulic piston). The first piston 10, which is contained in a chamber 24 within the breech head 2, in turn drives a smaller, second piston 11 (also referred to herein as a hydraulic/pneumatic piston or simply a pneumatic piston), by virtue of a second amount of hydraulic oil residing between the pistons. The second piston compresses a light gas within breech chamber 25. The light gas is placed within the breech chamber between firing rounds from a light gas source 40. At the end of the breech chamber resides a rupture disk 20.3. Upon reaching a particular pressure and temperature, the rupture disk 20.3 fails, allowing the light gas to pass through a reducing cone 20 to a projectile 22, located at or near the apex of the cone. The projectile is impacted by this high pressure gas causing the projectile to accelerate and exit the barrel 9 at a high rate of speed.

Producing a desired velocity and force of a projectile, is one of the keys in designing a light gas gun. The application of the light gas gun will necessitate a particular set of design parameters, whether the application is for seismic exploration, miniature satellite launching, or defense. For example, a specific applications may a specific geometry and mass of a projectile, the size of the breech, the dimensions of the reducing cone, and finally the length of the barrel.

Figure 3A:
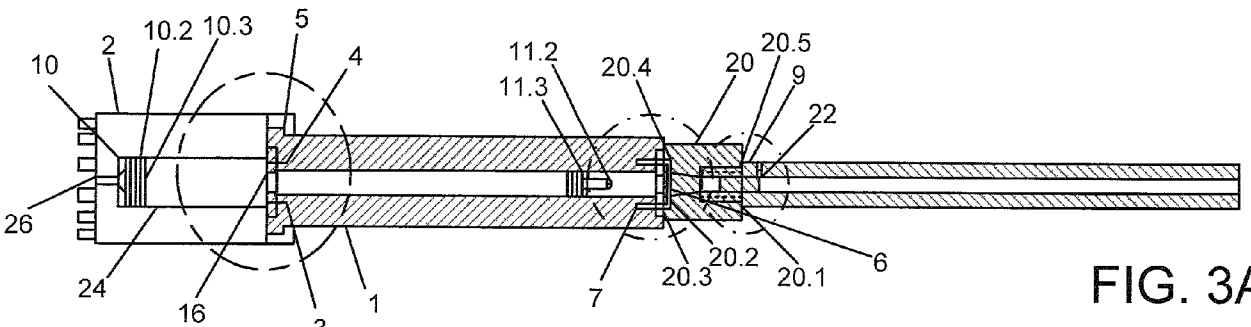
FIG. 3A is a sectioned view of the light gas gun shown in FIG. 2.

Referring to FIG. 3A, the light gas gun includes a hydraulic breech head 2, in which the breech head chamber 24 resides. The breech head is designed to house the hydraulic piston, is preferably cylindrical, and can be of any size as required by the specific design requirements for the application, which requirements include, for example, the work to be performed, the pressures required, and/or the desired velocity of the projectile.

The breech head 2 may be a high pressure hydraulic cylinder and may be sized as required to provide an advantageous ratio of compression to the second piston 11, contained within the breech chamber 25. This arrangement should provide the desired pressures as necessary to produce the forces necessary for a specific application. Second piston 11, in turn, may also be sized in view of the specific application and the chosen size of the projectile 22.

The fluid confined between the hydraulic piston and the hydraulic/pneumatic piston is the medium through which the propulsive force is transferred from the hydraulic piston to the hydraulic/pneumatic piston. The confined fluid is pushed from the hydraulic breech head into the breech chamber, which houses the hydraulic/pneumatic piston.

To avoid unnecessary losses, the hydraulic piston (first piston 10) may be placed in a dual-directional, double-sealed system, which provides a substantially complete seal of the hydraulic fluid located within the breech head at the various working pressures and allows for rapid decompression. The stroke length of the first piston 10 will vary according to the operating pressures required for a given application. Due to the fixed volume of fluid residing between the first piston 10 and the second piston 11, the amount of fluid compression should be a consideration when working with these high pressure systems. Because there is no shaft between the hydraulic piston (first piston) and the hydraulic/pneumatic piston (second piston), the force transferred from the hydraulic piston to the hydraulic/pneumatic piston is proportional to the ratio of the cross-sectional areas between the two pistons. The velocity of the respective pistons is inversely proportional to this ratio. This ratio, consequently, also determines the pressure of the light gas.

The breech chamber 25 should be designed to meet the strict requirements of working with a light gas such as helium. Seals on this piston should meet the requirements of working with high pressure hydraulic fluids and also meet the requirements of working with high pressure light gases. In addition, specific wear rings may be installed to center the piston within the breech chamber and to mitigate any abrasive qualities which could impact the breech chamber wall finish.

Figure 2:
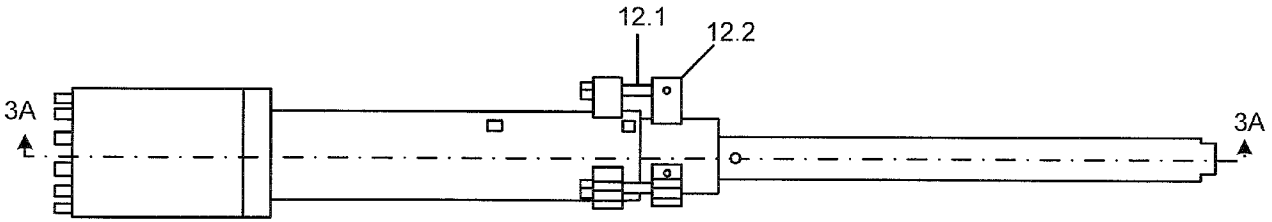
FIG. 2 is a side view of a light gas gun according to one example of the present disclosure.
Figure 3D:
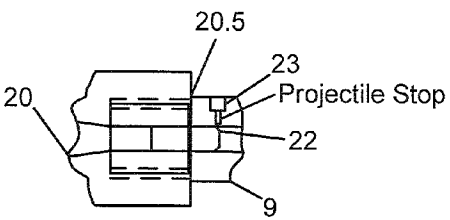
FIG. 3D is a sectioned view of the light gas gun shown in FIG. 2, providing detail of the projectile located at or near the apex of the reducing cone.

In the example shown in FIGS. 2-3D, the first piston 10 has seals 10.2, which contain the pressure and separate the pressure from one side of the piston to the other. Wear rings 10.3 make sure that the first piston 10 is properly centered within the breech head chamber 24 and prevents direct contact with the cylinder wall which would cause scoring. The first piston is driven by hydraulic oil that enters the light gas gun through a hole 26, which may be located in the breech head face and which causes the piston to travel down the breech head chamber 24 and compress the second amount of hydraulic oil residing between the pistons. The second amount of oil is, in turn, forced against a near face of the second piston 11, which piston has its own seals 11.3 to prevent oil from seeping beyond the end of the piston and mixing with the light gas in the breech head chamber 25. Seal 11.3 should be made from appropriate materials that will handle the pressure of the oil and seal the light gas so that it will remain on the distal side of the second piston.

The finish quality of the breech chamber walls in the breech 1 should be of a very high quality in order to prevent the light gas from passing seal 11.3, thereby contaminating the oil with entrained helium. For example, the finish of the cylinder wall may be designed to meet 3-8 micro-inch standards in order to allow the seals of the hydraulic/pneumatic piston to hold pressures up to 60,000 psi.

The hydraulic oil should also be specific to the operating pressures being used. Compression breakdown will result in increased particulates which can cause wear on the seals, wear rings, and cylinder wall finish. Optionally, a different type of hydraulic oil may be used one either side of the first piston.

According to the present disclosure, light gas is emitted from the breech chamber at a very rapid rate through a specifically designed rupture disk 20.3. Designed in accordance with the requirements of a specific application, the rupture disk is designed to fail when the temperature and pressure of the light gas in the breech chamber 25 reach a chosen value. The rupture disk 20.3 will likely stretch just prior to failure.

The thickness of the rupture disk 20.3 is designed specifically for the operating pressures being used. If the rupture disk is too thin the light gas will be released prior to reaching the desired pressure. Inversely, if the rupture disk is too thick, the rupture may not occur with sufficient speed to release the light gas at a high rate. Therefore, the present disclosure provides that a punch 11.2 may be formed on the face of second piston 11 to cause the rupture disk to tear when the light gas has been compressed to a specific volume. This feature allows a wider range of tolerances for the thickness of the rupture disk and ensures proper performance.

Figure 3C:
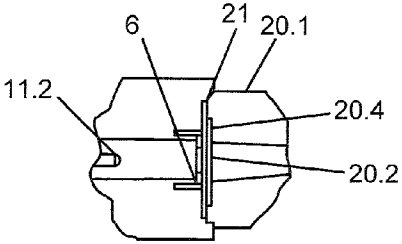
FIG. 3C is a sectioned view of the light gas gun shown in FIG. 2, providing detail of the rupture disk.
Figure 3B:
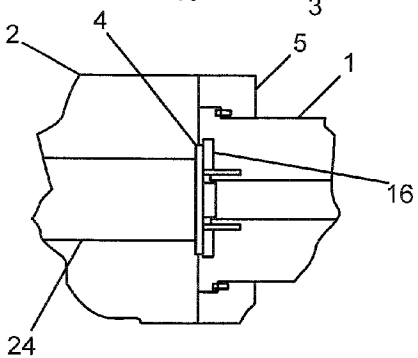
FIG. 3B is a sectioned view of the light gas gun shown in FIG. 2, providing detail of the union between the breech head and the breech.

According to the example shown in FIG. 3C, the second piston 11 includes a punch 11.2, extending a chosen difference from the face of the second piston, which may be used to puncture the rupture disk 20.3, when the light gas has been compressed to a chosen volume. Each rupture disk may be larger than the diameter of the breech chamber 25 and can be formed with score lines on one or both faces. The score lines ensure that when the punch pierces the rupture disk a tear will occur allowing the light gas to be released very rapidly. The rupture disk may be held in position by the pressurized light gas and a depression (preferably circular-shaped) formed into the reducing cone 20, which is slightly larger than the outside diameter of the rupture disk. The depth of this depression will be equal to the thickness of the rupture disk 20.3, so that the breech and reducing cone fit together tightly. An o-ring 20.4 may be provided to prevent the light gas from seeping around the rupture disk and exiting through the barrel.

Upon exiting through the rupture disk, the light gas will move through a reducing cone, designed to take transport compressed gas to a smaller diameter chamber, called the barrel. Depending on the forces desired and the velocity of the projectile for the application, the reducing cone may be designed to have a diameter equal to the breech chamber at one end and a diameter equal to the inner diameter of the barrel at the other. This reduction in size compounds the pressure being generated in the breech chamber directly proportional to size of the projectile or barrel chamber, which should be very similar.

The barrel is also designed specifically for a given application, which may take into account the mass and geometry of the projectile, the speed of the projectile, the volume of the breech, and the operating pressures associated therewith. In addition to these considerations, the diameter of the barrel affects the mechanical advantage resulting from taking the compressed gas from the breech diameter to that that of the barrel diameter. For example, ignoring losses, if the barrel diameter is a fourth of the size of the breech chamber, then the force on the projectile within the barrel is multiplied by four.

The projectile may be designed to have a seal surrounding it to contain the compressed gas and force the projectile out of the barrel at high velocities. In some applications the actual projectile may be placed within a sabot for the firing process. Using a sabot will ensure that the projectile will maintain a tight seal within the barrel during the firing process of the gun. The sabot will then fall away from the projectile once it has left the barrel.

The light gas gun apparatus described herein may be useful for work within remote regions where power is not available. The total amount of power equired by this system can be stored within a standard 12 volt automobile battery. The energy required for compressing hydraulic oil (the first amount of hydraulic oil) and for compressing helium for placement within the breech chamber prior to firing, may utilize compressed gas cylinders and specifically designed pneumatic pumps to build the pressures being used. The application of a seismic gun can then be operated in any locality without the need of permits or the import of explosives. The materials used in the operation of this apparatus can be purchased in essentially all jurisdictions.

Other particular applications of this technology can be found in satellite launching of either communication or GPS locating devices to be used as a reference point once in orbit. Small communication satellites can be put in place for military use when working in areas where satellites are not present. Deployment of these types of satellites could occur in minutes and be in service rapidly. The cost to deploy the satellite and the cost of manufacturing such a satellite would be substantially less than conventional technology.

Another aspect of the present disclosure provides a method for accelerating a projectile using a light gas gun. The method includes providing hydraulic oil at high pressure to a first chamber; compressing a light gas in a second chamber of a second cross-sectional area, using a series of at least one piston, wherein a cross-sectional area of the second chamber being smaller than a cross-sectional area of the first chamber; and expelling the compressed light gas behind a projectile once the light gas has been compressed to a pre-determined level; and accelerating the projectile through a barrel. The method may be performed using two pistons, wherein a first piston resides in the first chamber and a second piston resides in the second chamber. The step of expelling the compressed light gas may be performed using a punch attached to the second piston to pierce a rupture disk when the light gas has been compressed to said pre-determined level, which may be a volume, or a pressure, or a combination thereof with temperature. The light gas may be expelled into a reducing cone located at the proximal end of the barrel when viewed from the breech head, wherein the projectile may be located at or near the apex of the reducing cone.

The light gas gun of the present disclosure is very versatile and can perform with very high accuracy when each of the respective parameters is correctly accounted for. An example of the light gas gun disclosed herein, and as shown in the figures, is given below:

The example shown in FIGS. 2-3D is constructed by forming major parts from a resilient material, such as stainless steel, the main parts including the breech 1, the breech head 2, and the barrel 9, which may also include the reducing cone section 27. The breech 1 and breech head can be held together by breech ring 5. Stainless steel bolts 12.1 may be used to hold the breech and breech head together with the barrel and cone section, aligning the chambers 24, 25 therein with the reducing cone 20, and should be strong enough to withstand the forces present during the compression of the light gas. These bolts may be configured to swivel out of the way after each shot made so that an operator will be able to replace the rupture disk 20.3. The swivel bolts are held in brackets 12.2 by pins 12.3.

Opening the light gas gun may be performed by utilizing a thread rod that will open the distance between the breech and the reducing cone by turning of a cranking wheel located at the end of the hydraulic breech head. Thus, the two chambers will be separated for the rupture disk and the projectile installation and then turned the opposite direction to close the two chambers. The four reducing cone bolts will be then swiveled back into place and tightened for the next shot.

Other features of the construction of the light gas gun include piston retaining rings 16, 21 located at the downstream end of the breech head chamber 24 and breech chamber 25. The piston retaining rings are attached to the respective locations prior to the assembly of the light gas gun using, for example, head cap screws 3. As part of the assembly, o-rings 4 and 6 are included to prevent the pressurized contents of the respective chambers from seeping out of the light gas gun, thereby deteriorating the capability thereof. In this example, another o-ring 20.5 is placed at the junction of the cone section 27 and the barrel 9. A projectile stop 23 may also be included to prevent the projectile from being prematurely expelled from the light gas gun.

According to this example, the light gas, preferably helium, may be charged into the breech chamber within a range of 1000 and 6000 psi. The helium is supplied by light gas system 40, which includes a helium tank 41 and a high pressure pneumatic pump 42, controlled by control valve 43. The helium will be piped to the high pressure pneumatic pump at 1000 psi, wherein control valve 43 will be activated and the gun will be charged to the desired set point, as indicated by a pressure transducer mounted to the breach housing, which set point can be established anywhere between 1000 to 6000 psi. Simultaneously, control valve 35 is opened in the hydraulic oil system 30 to allow the hydraulic oil, contained behind the hydraulic piston, to return to the reservoir 31. At the completion of the helium charge, control valves 43 and 35 will be closed.

The propulsive force for the firing of the light gas gun is provided by the hydraulic oil entering the breech head chamber from hydraulic oil system 30, which the present example provides at pressures up to approximately 15000 psi. Hydraulic oil system 30 includes an oil reservoir 31; a high pressure hydraulic pump 32; a series of control valves 33, 34, 35, and an accumulator 36.

Once the projectile has been placed in the barrel and the helium charge is complete, the light gas gun is prepared to fire by allowing accumulator 36 to be charged with hydraulic oil to a prescribed set point. This set point can be establish anywhere between 2500 and 15000 psi. Control valve 33 will be activated and will remain open until the prescribed set point has been obtained, after which, when indicated by a pressure transducer in the accumulator 36, control valve 33 will be deactivated.

The operation of this system may be controlled by a Process Logic Controller (PLC). The PLC is programmed to control the entire operation up to the time just before the projectile is fired. The shot will be controlled by an operator with a manual switch. The manual switch will activate control valve 31, which will open rapidly to allow the flow of compressed hydraulic oil to move to the breach head assembly at a rapid rate, thereby causing the gun to fire.

In this example, the light gas can be compressed by first piston 11 to approximately ten times the charge pressure in the present example, at which point the punch 11.2 pierces rupture disk 20.3. Because of the advantageous design of the punch, the light gas gun of the current example may be operated with three rupture disks. A first rupture disk may be used with operating pressures of 1000-2500 psi. A second rupture disk may be used from 3000-4500 psi of charge pressures of helium. A third rupture disk may be used from 4500-6000 psi charge pressures. Each one is designed to hold the pressures of compressed helium to the ten times the charge pressure, until punch 11.2 breaks the rupture disk, thereby emitting the helium substantially instantaneously (within about 0.001 sec) and allowing the helium to enter the reducing cone 20. The reducing cone is designed to funnel the compressed helium to the barrel 9 where the projectile 22 is resting. The reducing cone causes the gas pressure to compound to the ratio of the piston 11 to the projectile 22 size which in this example is approximately 4 times.

The horizontal motion of second piston 11, is four times the total movement of first piston 10, by virtue of the ratio of the cross-sectional area of the breech head chamber, wherein resides first piston 10, when compared to the breech chamber, wherein resides second piston 11. The volume of oil between piston 10 and 11 is equal to the volume covered by the stroke length of piston 11 to compress the volume of light gas to 10 times its original volume, plus the maximum volume of compression of the hydraulic oil when compressing the light gas to its maximum pressure. Thus, the maximum compression of hydraulic oil, if for example we are compressing the light gas to 60000 psi, will be 19.68% of the original volume of oil under no pressure. Various oils will have different compressions, based off of its bulk modulus, and by knowing the bulk modulus of the specific oil being used, we may calculate the compression rate of the oil.

The projectile 22 used in the present example, or with any of the alternative designs suggested above, may be a mild steel pellet, capsule, or canister, and can be variable in weight. The projectile should have a diameter roughly equal to the inside diameter of the barrel 9, which in the present example, is one fourth of the size of the cylinder of compressed gas.

The light gas gun of the present example may deliver a force on the projectile ranging from 40,000 to 240,000 psi. This can cause the projectile to reach speeds of approximately 4.81 to 28.88 km/sec, and result in a significant amount of force at point of impact (80,000 ft-lbs., to 1.6 million ft-lbs) or result in the projectile reaching a specific altitude.

It should be emphasized that the above-described embodiments of the present apparatus and method, particularly, and "preferred" embodiments, are merely possible examples of implementations and merely set forth for a clear understanding of the principles of the disclosure. Many different embodiments of the disclosure described herein may be designed and/or fabricated without departing from the spirit and scope of the disclosure. All these and other such modifications and variations are intended to be included herein within the scope of this disclosure and protected by the following claims. Therefore the scope of the disclosure is not intended to be limited except as indicated in the appended claims.

The invention claimed is:

1. A system for accelerating a projectile using a light gas comprising a high pressure system and a light gas gun having at least one piston, wherein the high pressure system provides a working fluid at high pressures to the light gas gun to produce a propulsive force that is transferred to the projectile using the piston to compress a light gas, wherein the light gas gun comprises a first piston and a second piston, a second working fluid residing between the first piston and the second piston, the second piston having a smaller cross-sectional area when compared with the first piston, and wherein the second piston is used to compress the light gas behind a plurality of rupture disks having different rupture pressures.

2. The system of claim 1, wherein the propulsive force is produced without the use of explosives.

3. The system of claim 1, further comprising a light gas source for supplying the light gas to the light gas gun.

4. The system of claim 1, wherein the light gas is helium.

5. The system of claim 1, wherein the working fluid at high pressure is provided to the light gas gun behind at least one piston.

6. The system of claim 3, wherein the rupture disks are placed between the light gas and the projectile, which is located in a barrel of the light gas gun near the rupture disks.

7. The system of claim 6, wherein the light gas gun further comprises a reducing cone to transition the flow of the light gas into the barrel.

8. The system of claim 1, wherein the light gas is supplied to the light gas gun in the range of 1000-6000 psi.

9. The system of claim 1, wherein the working fluid is supplied to the light gas gun at pressures of up to 15,000 psi.

10. The system of claim 1, wherein the light gas is compressed by the light gas gun to a pressure that is approximately ten times the pressure at which the light gas is supplied to the light gas gun.

11. The system of claim 1, wherein the pressure exerted by the light gas on the projectile is in the range of 40,000 to 240,000 psi.

12. The system of claim 1, wherein the speed of the projectile as it leaves the light gas gun is in the range of 4.81 to 28.88 km/sec.

13. The system of claim 1, wherein the impact of the projectile on a target is in the range of 80,000 ft-lbs to 1.6 million ft-lbs.

14. A light gas gun, comprising:

a pneumatic piston residing in a breech chamber for compressing a light gas;

a rupture disk for retaining the light gas within the breech chamber until the light gas reaches a predetermined volume;

a punch formed on a leading face of the pneumatic piston for puncturing the rupture disk when the light gas reaches the predetermined volume; and a barrel, into which the light gas enters upon the puncturing of the rupture disk, wherein a projectile may be place in the barrel near the rupture disk.

15. The light gas gun of claim 14, wherein the light gas is helium.

16. The light gas gun of claim 14, wherein the light gas gun further comprises a hydraulic piston residing in a breech head chamber, the hydraulic piston transferring a propulsive force to the pneumatic piston, wherein a working fluid, such as for example hydraulic oil, is contained in between the two pistons.

17. The light gas gun of claim 14, wherein the breech head chamber is formed to have a greater cross-sectional area than the breech chamber.

18. The light gas gun of claim 14, wherein the hydraulic piston is driven by a propulsive force supplied by a high pressure hydraulic pump.

19. The light gas gun of claim 14, wherein the propulsive force is provided by an explosive charge.

20. The light gas gun of claim 14, wherein the rupture disk is scored on at least one surface.

21. The light gas gun of claim 14, further comprising a reducing cone located between the rupture disk and the barrel.

22. The light gas gun of claim 14, wherein the hydraulic and pneumatic pistons include seals to prevent the contents on either side of the pistons from seeping around the piston.

23. A method for accelerating a projectile using a light gas gun, comprising:

providing hydraulic oil at high pressure to a first chamber containing a first piston;

compressing a light gas to a pre-determined level in a second chamber containing a second piston, wherein a cross-sectional area of the second chamber being smaller than a cross-sectional area of the first chamber; and expelling the compressed light gas behind the projectile by using a punch attached to the second piston to pierce a rupture disk in the second chamber once the light gas has been compressed to said pre-determined level; and accelerating the projectile through a barrel.

* * * * *